United States Patent [19]

Solomon

[11] 4,237,585

[45] Dec. 9, 1980

[54] SECURITY BUCKLE FOR WRIST WATCH METAL BRACELETS

[76] Inventor: Marcel Solomon, 2553 Younge St., Toronto, Ontario, Canada, MaP 2H9

[21] Appl. No.: 934,971

[22] Filed: Aug. 18, 1978

Related U.S. Application Data

[63] Continuation-in-part of Ser. No. 781,461, Mar. 25, 1977, abandoned.

[51] Int. Cl.[3] ..... A44B 11/20

[52] U.S. Cl. ..... 24/190; 24/265 WS; 224/175

[58] Field of Search ..... 24/265 WS, 197, 193, 24/196, 73 J, 190, 181; 224/175

[56] References Cited

U.S. PATENT DOCUMENTS

| | | | |
|---|---|---|---|
| 2,446,065 | 7/1948 | Starke | 24/265 WS |
| 3,453,821 | 7/1969 | Kian | 224/175 |
| 3,797,716 | 3/1974 | Mochizuki | 24/265 WS |

FOREIGN PATENT DOCUMENTS

| | | | |
|---|---|---|---|
| 2402144 | 7/1975 | Fed. Rep. of Germany | 24/190 |

*Primary Examiner*—Kenneth Dorner

*Attorney, Agent, or Firm*—Stevens, Davis, Miller & Mosher

[57] ABSTRACT

An improved security buckel for a wrist watch metal bracelet is disclosed which utilizes a first and second frame work, one mounted within the other, which are provided with a limited amount of relative sliding movement. A spur of the first frame work is in engagement with or is disengaged from a first traverse element of the second frame work when the two frame works are respectively in a first and second relative position. An inflexible removable traverse element is attached to the first frame work and to a first portion of the metal bracelet. A locking band attached to a second portion of the metal bracelet passes under the first traverse and is engageable with the spur when the frame works are in the second relative position and further passes through a space defined by the inflexible removable traverse element and a second traverse element on the first frame work when the frame works are in the first relative position. The second frame work includes a traverse portion engaging with the inflexible removable traverse element for locking the second frame work in the fist relative position when the locking band is within the defined space. A protection plate may be provided to protect a users wrist from marks left by the buckle.

9 Claims, 9 Drawing Figures

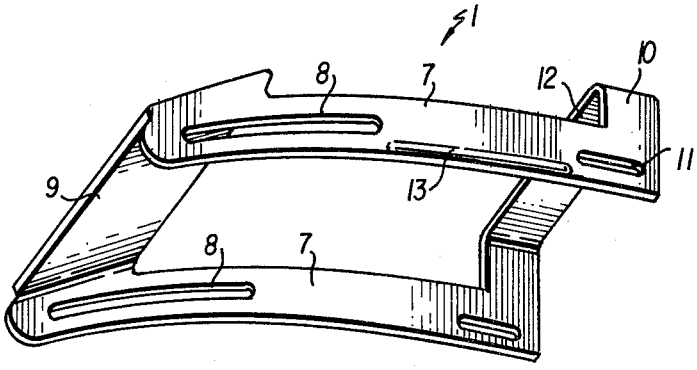
FIG. 1
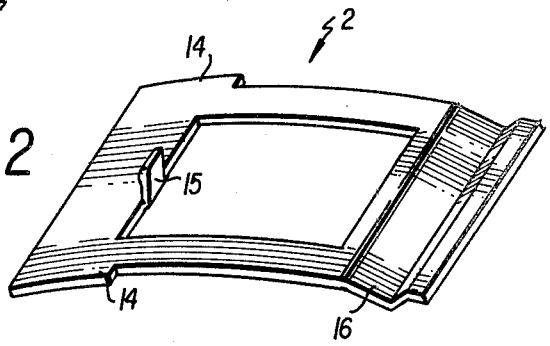
FIG. 2
FIG. 3
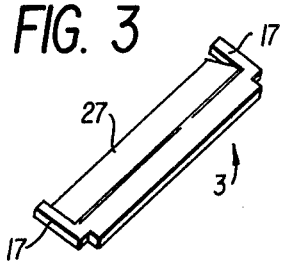
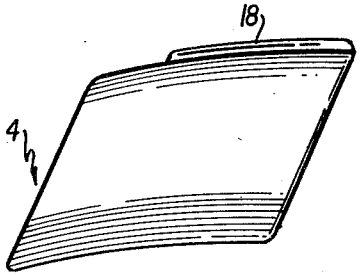
FIG. 4
FIG. 5
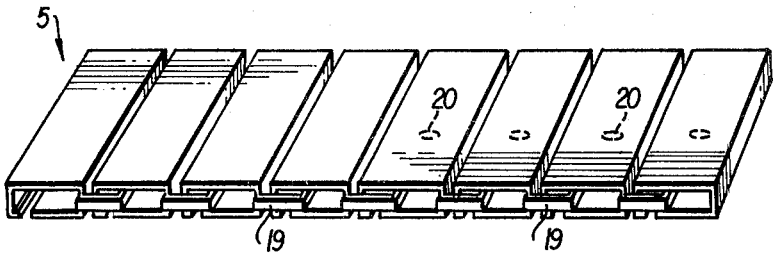
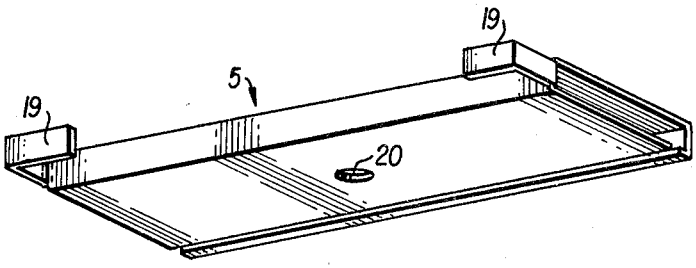
FIG. 6

SECURITY BUCKLE FOR WRIST WATCH METAL BRACELETS

This application is a continuation-in-part of Ser. No. 781,461 filed Mar. 25, 1977, now abandoned.

BACKGROUND AND SUMMARY OF THE INVENTION

The present invention relates to a buckle used to close a wrist watch metal bracelet, ensuring an absolute fixation of the attached watch.

Buckles used to close metal wrist watch bracelets are known and are manufactured from many pieces, some of which are very breakable and possibly easily detached when the buckles are exposed to applied forces, such as caused by accidents, etc. Oftentimes, the buckles become self-opening even after a very short use, i.e., even though brand new, causing the two portions of the metal bracelet to come apart.

For all these reasons, the user risks accidently losing his watch or dropping it. These problems and inconveniences with prior art buckles can be avoided by designing a buckle based on the concept disclosed hereinbelow which offers a high degree of security making it absolutely impossible even when closed for the buckle pieces to detach from each other unless a force is applied equal to that used when the buckle was manufactured (4–5 tons). The untimely opening of this buckle is equally out of the question, even if the point of fixation with the bracelet is large and is indifferent with respect to the direction of force applied to the two portions of the bracelet secured together by the buckle.

In other words, it is impossible to close or open this buckle, without the express manipulation of the user.

The inventive idea of this buckle is based on a new system of locking realized in a form of a casket, characterized in that it is composed of two frame works, named passing frame work and locking frame work, fitted together and capable of sliding a limited distance one against the other, one portion of the bracelet being fixed on the passing frame work and a second portion of the bracelet being attached to a portion of a band specially designed as a locking part. The locking band has a series of links and associated holes therein and is meant to be introduced into an aperture of the passing frame work. A selected link and associated hole of the locking band is engaged with a spur of the locking frame work, and the band passes between a traverse of the passing frame work and the back part of the locking frame work. The locking frame work in hampered from displacement towards the front with respect to the passing frame work by the spur engaging with a traverse on the passing frame work and is hampered from displacement on the backside because of a jut which abuts against a third traverse attached on the passing frame work. This construction prevents an untimely opening of the buckle. A protection plate is attached on the lower sides of the lateral walls of the buckle for protecting it against marks which might otherwise be left on a users wrist.

The attached drawings represent an exemplification of one embodiment of a security buckle for wrist watch metal bracelets constructed in accordance with this invention.

BRIEF DESCRIPTION OF THE DRAWINGS

FIG. 1 represents a perspective view from below of a passing frame work used in an embodiment of the invention.

FIG. 2 represents a perspective view from above of a locking frame work used in the same embodiment.

FIG. 3 represents a perspective view from above of a removable third traverse.

FIG. 4 represents a perspective view from below of a protection plate.

FIG. 5 represents a perspective view from above of the part of the locking band used to hook the buckle.

FIG. 6 represents a perspective view from below of a link of the locking band.

Figure 7:
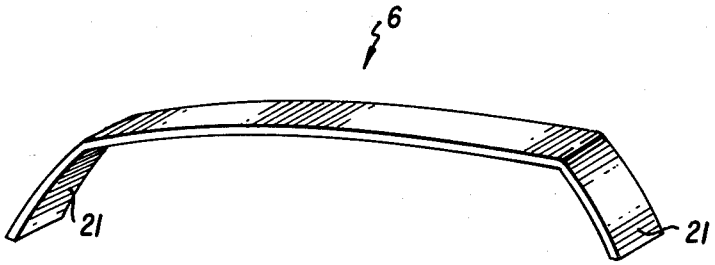
FIG. 7 represents a perspective view from above of a spring plate used in the locking band links.

The buckle for the wrist watch bracelets represented in the drawings is composed essentially from two frame works, a passing frame work 1 (FIG. 1) and a locking frame work 2 (FIG. 2), a removable third traverse element 3 (FIG. 3), a protection plate 4 (FIG. 4), and the part of the band 5 locking the buckle (FIG. 5).

The passing frame work 1 is in the form of a rectangular prismatic profile, slightly curved along its length. It includes two lateral vertical walls 7, each having at its front end a first slot 8 of rectangular form with rounded ends. The walls are bridged at their front ends by a traverse element 9. On their rear ends, the walls 7 are enlarged as shown by numeral 10 and have respective apertures 11 in their lower extremities which take the same general form as the slots 8. The upper extremeties of the enlarged portions 10 of the walls are joined by a second bridging traverse element 12.

The passing frame work 1 can be easily manufactured by cutting a metal sheet and thereafter bending it.

The locking frame work 2 (FIG. 2) is in the form of a plate having a rectangular hole therein. The plate has a slight curvature corresponding to that of the passing frame work 1 and further has a width equal to the distance between the two walls 7 of the passing frame work 1.

On the fore part, the locking frame work 2 presents two lateral ears 14, and half way along the length of the ears, a spur 15 directed upright, its extremity being curved on the front.

The locking frame work 2 has near its back extremity a cross curvature 16 in the form of a channel or gutter obtained by flanging which forms a downwardly directed stopping device.

Figure 8:
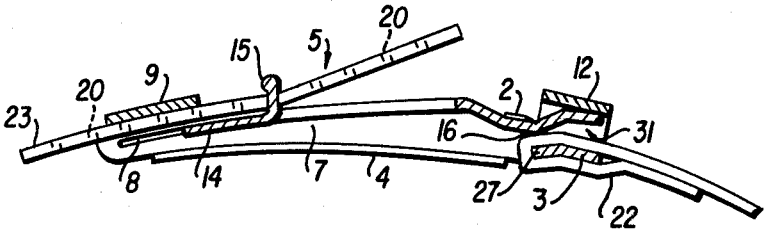
FIG. 8 represents an axial section of the buckle when one portion of the metal bracelet is fixed to the passing frame work, and the locking frame work, engaged with the second bracelet portion via the locking band, is set to be introduced in its emplacement into the buckle.

The locking frame work 2 and the passing frame work 1 are fitted one in the other during the manufacture, in such a manner that the ears 14 of the frame work 2 are engaged in the slots 8 of the passing frame work 1 (FIG. 8). With this arrangement, the two frame works 1 and 2 can no longer be detached one from the other, but can slide relative to one another for a limited distance; the ears 14 being stopped by the ends of the slots 8 of the frame work 1 to establish the limit of relative sliding movement.

A third traverse element 3 also extends across the passing frame work 1. It is an inflexible profiled removable traverse element of generally rectangular shape with the two short sides having respective ears 17. The rectangular profile includes a sloping portion 27 which is designed to provide the required inflexibility (rigidity) needed for the primary function of this element, namely, to impede the untimely opening of the buckle when locked. The traverse element 3 also serves for the attachment of a first portion 22 (FIG. 8) of the metal bracelet to the buckle and can be easily manufactured from a metal sheet.

The profile of the traverse element 3 with a single sloping section on the front also receives for emplacement the back side of the locking frame work (FIG. 9), and shortens the height of the buckle.

The length of the two ears 17 is equal to the length of the two apertures 11 in the walls 7 and are introduced therein. To attach traverse element 3 to the buckle, the two ears 17 are pressed inside the apertures 11 by slightly forcing apart the two walls 7. Removal is accomplished in the same manner except that instead of pressing the traverse element 3 in, it is pulled out. The total length of the traverse element 3 comprising the two ears 17 is equal to the distance between the two exteriors of the walls 7.

The third traverse element 3 and the second traverse element 12 define an important space 31 on the passing frame work 1.

FIG. 4 shows a protection plate 4 which prevents the buckle from leaving marks on the users wrist. The protection plate 4 is in the form of a rectangular plate with a slight curvature corresponding to that of the passing frame work 1 and has a width equal to the distance between the two exteriors of the walls 7. The protection plate 4 contains, on the two long sides of the rectangle, two attachment flanges 18 bent toward the middle which allow for the attachment of the protection plate 4 to the bottom of passing frame work 1. To this end, exterior channels 13 are provided on the passing frame work 1 which engage with the attachment flanges.

FIG. 5 shows a part of the band which is attached to a second portion of the metal bracelet and which is used to lock the buckle. It is made from links 5 which are attached to each other by claws and which have inside them an armature formed from spring plates. FIG. 6 shows the links 5 in more detail. All links are in the same shape, that of a rectangular prismatic profile. This rectangular prismatic profile presents, at the two extremities of a narrow wall, two attachment claws 19. This profile is obtained by bending a metal rectangular sheet, the two long sides of the rectangle being reunited in the lower wall.

The links which are at the beginning of the locking band, i.e., nearest the second bracelet portion, do not have holes and are followed by other links, each having a center hole 20 therein passing through the upper and lower walls.

The holes in the links of the locking band are used to fix the length required by the person using the bracelet with this buckle. The holes are provided for engagement with the spur 15 of the locking frame work 2, the choice of the hole 20, i.e., link of the band, engaging with the spur 15 being determined by the required length of the bracelet.

The armature of the locking band is made from small spring plates found inside on the links. The small spring plates (FIG. 7) are all in the same rectangular shape and are circularly bent lengthwise.

In functioning position, the short sides 21 of each spring plate are pressing on the interiors of the attachment claws 19 to exert pressure with the middle of their curvature on the interior of the lateral wall of the link, holding in this way the succeeding links in extended position in a straight plane.

To assemble the component parts of the band locking the buckle, two attachment claws of a link are pressed into the interior of a second link, in which a small spring plate has already been placed in the described position. Thereafter the claws are forced towards the middle of this second link by the spring plate. This operation is repeated for each link. In this way, the links are attached successively, each one to another, with their similar walls in the same position, the two narrow walls of two successive links being engaged one close to the other.

In linking together the links forming the locking band, a first group of links without holes is succeeded by another number of links with holes; once this is done, the locking band is in a functioning condition. A locking band constructed in the manner just described is extremely strong. Attempts to force the band to break, taking into consideration the thickness of the metal sheet and the amount of bending practiced on the distances allowed by the sizes of the link, have shown this band to be at least 40 times (experience result) stronger than the links currently used in the construction of metal watch bracelets. While providing a high degree of strength, the band as described has characteristics identical to those of a leather strap, i.e., suppleness, flexibility, and elasticity.

As noted, the first portion of the bracelet, indicated by numeral 22, is attached to the passing frame work with the help of the removable third traverse element 3. The second portion of the bracelet having attached to it the locking band of FIG. 5 is indicated by the number 23.

FIG. 8 shows how the locking band of bracelet portion 23 is introduced into the buckle between the traverse element 9 of the passing frame work 1, and the front of the locking frame work 2. After the locking band is introduced between the traverse element 9 and the locking frame work 2, one of the holes 20 of the locking band is made to engage with the spur 15 on the locking frame work 2. Thereafter, a retraction made on the band portion 23, toward the left in FIG. 8, acts on the spur and displaces the frame work 2 toward the left until the ears 14 press against the left extremities of the slot 8 of the passing frame work 1.

With the leftward movement of the locking frame work 2, the channel 16 also moves leftwardly, slides in behind, falls down and contacts with band 22 at the base of the passing frame work 1; that is, with the band 22 formed around third traverse element 3.

Figure 9:
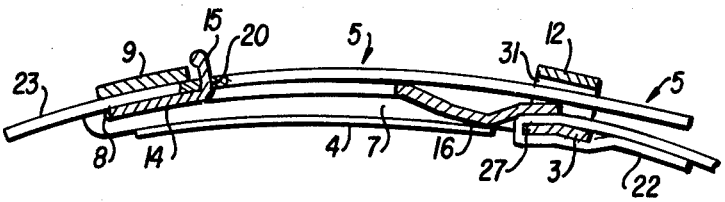
FIG. 9 represents a section identical to FIG. 8, when the buckle is in a locked state.

Because of the afore-mentioned "fall" of the channel 16 of the locking frame work 2, a space is created between the traverse element 12 of the passing frame work 1 and the back part of the locking frame work 2 so that the free end of the locking band can now be inserted in this space as is shown in FIG. 9.

The abutment of the channel 16 against the front slope of band 22 formed around the third traverse element 3 prevents the locking frame work 2 from sliding toward the right as viewed in FIG. 9; and, because the spur 15 presses against the traverse 9, the locking frame work 2 is prevented from sliding to the left side. As a result, the locking frame work 2 is positively held in place, and the band cannot come undone from its locked condition no matter what pressure is exerted.

To detach the two portions of the band from their locking, a reverse operation to that described above is carried out. The band portion 23 is removed from the back part of the passing frame work 1 by sliding it to the left in FIG. 9 and pulling it out from the space formed by the traverse element 12 and end of the locking frame work 2. Thereafter, the locking frame work 2 is raised to free channel 16 from band 22 around the third traverse element 3, and the locking frame work 2 is slid to the right in FIG. 9 relative to the passing frame work 1 until it is in the position shown in FIG. 8.

At this point, the band portion 23 is pulled slightly out and upward until the spur 15 of the frame work 2 disengages from the hole 20 in which it was engaged. The locking band 5, attached to the portion 23, is therefore pulled out of the passing frame work 1 by passing under the traverse element 9.

The described and illustrated buckle ensures a positive securement of a metal watch bracelet to a user which cannot be opened untimely without the express manipulation of the user.

The buckle as described, may be realized in various manufacturing forms, but working on the same principle, and can be used also for other purposes.

The band per se (FIG. 5) serving to close the described buckle may be realized in various manufacturing forms, with or without an armature, and could also be used for other purposes.

Although an embodiment of the security buckle and associated locking band of the invention have been described, it should be apparent that many modifications may be made to the invention without departing from the spirit and scope thereof. Accordingly, the foregoing description and drawings are merely exemplary of the invention which is limited solely by the appended claims.

What is claimed is:

1. A security buckle for attaching together two portions of a band comprising:

a first frame work having a pair of longitudinally disposed lateral side walls interconnected by a first traverse element at a forward end of the sidewalls and a second traverse element at the rearward end of the sidewalls, a second frame work fitted within said first frame work for limited sliding movement with respect to said first frame work between a first and second relative rest position, said second frame work including a downwardly projecting traverse portion, and a raised spur adapted to abut said traverse element, an inflexible removable third traverse element mounted to and extending between said sidewalls and disposed under said second traverse element, a portion of said third traverse element having a longitudinally disposed surface which slopes relative to the remainder of said third traverse element, said third traverse element being positioned to cooperate with said traverse portion to lock said second frame work against rearward sliding movement with respect to the first frame work, said third traverse element being attachable to one of said two band portions, said second traverse element and inflexible removable traverse element forming a space therebetween, said space being partially occupied by a rearward portion of said second frame work, and a locking band attachable to the other of said two band portions to form the end part thereof, said locking band including a plurality of spaced longitudinally disposed holes being engageable with said spur when said first and second frame works are in said second mutual rest position where said spur is not in abutment with said first traverse element, said locking band thereafter being insertable into said space only when said first and second frame works are relatively slid to said first relative rest position where said spur abuts said first traverse element, said locking band, when inserted in said space, cooperating with said rearward portion of said second frame work and third traverse element to lock said first and second frame works in said first relative rest position.

2. A security buckle in accordance with claim 1 wherein said locking band is constructed as a plurality of metal links, at least some of which are provided with a spur engageable hole.

3. A security buckle in accordance with claim 1 further comprising means attached to the bottom of said sidewalls for preventing marking of a user by said buckle.

4. A security buckle in accordance with claim 3 wherein said preventing means is a protection plate extending between said sidewalls.

5. A security buckle in accordance with claim 4 wherein said lateral sidewalls have exterior channels thereon and said protection plate is provided with flanges for engaging with said channels to hold said protection plate in place.

6. A security buckle in accordance with claim 1 wherein said first frame work includes a first pair of forwardly disposed apertures formed as two longitudinal slots respectively disposed in said side walls, and said second frame work comprises two lateral ears respectively engaged in said two slots.

7. A security buckle in accordance with claim 6 wherein each of said lateral side walls includes a second pair of rearwardly disposed apertures for receiving respective ears provided on said third traverse element.

8. A security buckle in accordance with claim 1 wherein said downwardly projecting traverse portion of said second frame work is made in the form of a transverse channel formed by a downwardly bent portion of said second frame work.

9. A security buckle for attaching together two portions of a band comprising:

a first frame work having a pair of longitudinally disposed lateral side walls interconnected by a first traverse element at a forward end of the sidewalls and a second traverse element at the rearward end of the sidewalls, a second frame work fitted within said first frame work for limited sliding movement with respect to said first frame work between a first and second relative rest position, said second frame work including a downwardly projecting traverse portion, and a raised spur adapted to abut said first traverse element, an inflexible removable third traverse element mounted to and extending between said sidewalls and disposed under said second traverse element, said third traverse element positioned to cooperate with said traverse portion to lock said second frame work against rearward sliding movement with respect to the first frame work, said third traverse element being attachable to one of said two band portions, said second traverse element and inflexible removable traverse element forming a space therebetween, said space being partially occupied by a rearward portion of said second frame work, a locking band attachable to the other of said two band portions to form the end part thereof, said locking band including a plurality of spaced longitudinally disposed holes being engageable with said spur when said first and second frame works are in said second mutual rest position where said spur is not in abutment with said first traverse element, said locking band thereafter being insertable into said space only when said first and second frame works are relatively slid to said first relative rest position where said spur abuts said first traverse element, said locking band when inserted in said space cooperating with said rearward portion of said second frame work and third traverse element to lock said first and second frame works in said first relative rest position, and, a protection plate attached to the bottom of said sidewalls and extending therebetween, said protection plate being provided with flanges for engaging with exterior channels provided on said lateral sidewalls to hold said protection plate in place.

* * * * *